US007461995B2

(12) United States Patent
Burnley

(10) Patent No.: US 7,461,995 B2
(45) Date of Patent: Dec. 9, 2008

(54) SOCKET RETAINER

(75) Inventor: Michael Burnley, Loudon, TN (US)

(73) Assignee: Taco Metals, Inc.

( * ) Notice: Subject to any disclaimer, the term of this patent is extended or adjusted under 35 U.S.C. 154(b) by 62 days.

(21) Appl. No.: 11/401,190

(22) Filed: Apr. 10, 2006

(65) Prior Publication Data

US 2006/0228168 A1 Oct. 12, 2006

Related U.S. Application Data

(60) Provisional application No. 60/669,621, filed on Apr. 8, 2005.

(51) Int. Cl.
*F16C 11/00* (2006.01)
*F16D 1/12* (2006.01)

(52) U.S. Cl. ..... 403/122; 403/144; 403/154; 403/161; 403/324; 403/325

(58) Field of Classification Search ..... 403/122, 403/129, 144, 152, 154, 161, 123, 319, 316, 403/325, 327, 321, 322.1, 324
See application file for complete search history.

(56) References Cited

U.S. PATENT DOCUMENTS 1,381,858 A * 6/1921 Bourdeau et al. ..... 426/541
2,778,236 A * 1/1957 Proctor ..... 474/211
4,072,320 A * 2/1978 Powell ..... 280/416.1
4,193,611 A * 3/1980 Fisk ..... 280/416.1
4,367,968 A * 1/1983 Ishida ..... 403/122
4,527,925 A * 7/1985 Bauer et al. ..... 403/143
4,943,182 A * 7/1990 Hoblingre ..... 403/349
5,725,234 A * 3/1998 Colibert ..... 280/512
5,895,167 A * 4/1999 Chang ..... 403/310
6,113,125 A * 9/2000 Colibert et al. ..... 280/511
6,186,693 B1 * 2/2001 Cloyd et al. ..... 403/122
D451,364 S 12/2001 Borotto et al.
D451,371 S 12/2001 Borotto et al.
6,523,441 B2 * 2/2003 Lee ..... 81/177.85
6,550,138 B2 * 4/2003 Billimack et al. ..... 29/888.05
6,609,850 B2 * 8/2003 Greb et al. ..... 403/137
6,823,762 B2 * 11/2004 Hu ..... 81/177.85

* cited by examiner

*Primary Examiner*—Robert J Sandy
*Assistant Examiner*—Nahid Amiri
(74) *Attorney, Agent, or Firm*—Robert M. Schwartz; Alfred Dassler

(57) ABSTRACT

A socket retainer for retaining a ball of a support post. The socket retainer includes a body with a channel formed therein for receiving the ball. A rotatable pin is disposed in the body substantially perpendicular to the channel. The pin has a cutout formed therein which corresponds to a diameter of the ball. The cutout aligns with the channel to allow entry of the ball into the channel. A spring is disposed at the pin for preventing an unintended rotation of the pin.

18 Claims, 4 Drawing Sheets

SOCKET RETAINER

CROSS-REFERENCE TO RELATED APPLICATIONS

This application claims the benefit of U.S. Provisional Application Ser. No. 60/669,621, filed on Apr. 8, 2005, entitled Socket Retainer; the prior application is herewith incorporated by reference in its entirety.

BACKGROUND OF THE INVENTION

1. Field of the Invention

The present invention pertains to a socket retainer that is used to mount a folding canopy or roof with support posts/tubes on a boat/marine vessel. More specifically, to a socket retainer that is mounted to a surface of a boat such as a gunwale, windshield, or radar arch for supporting a bimini top.

2. Description of the Related Art

The socket retainers are usually mounted on surfaces of a boat. The support post has a ball end that slides into the socket retainer. The socket retainer receives the ball end of the support post of the canopy and locks it in place so that the ball end cannot be removed from the socket without unlocking it. Once locked in the socket retainer, the ball is free to move and rotate in the retainer. The locking of the ball in the socket retainer is accomplished by a removable pin that is inserted into the socket retainer.

Socket retainers have a c-shaped channel and include two mounting holes for attachment to a surface, such as the gunwale, windshield, or radar arch of a boat. Socket retainers are made of stainless steel and include a plastic insert in the area that receives and retains the ball. A removable pin is inserted through the socket retainer to lock the ball end in place. The removable pin may be attached to a lanyard to prevent it from being lost or misplaced. The pin may also include a spring-loaded ball that keeps the pin from being unintentionally removed by vibration or other non-intentional ways.

The disadvantages of a socket retainer as described above are that the pin must be fully removed from the retainer to remove or insert the ball end of the canopy support pole. This can lead to difficulties in setting up the canopy. It also affords the possibility of pin being lost is the lanyard fails or if no lanyard is provided. If the pin is not disposed in the socket retainer, the pin can cause noise and may damage the surface of the boat.

SUMMARY OF THE INVENTION

It is accordingly an object of the invention to provide a socket retainer which overcomes the above-mentioned disadvantages of the heretofore-known devices of this general type and which provides a socket retainer that is more versatile and easier to use.

The socket retainer includes a pin that allows the ball end to be placed in the socket retainer and allows the ball to be removed from the socket retainer without the pin being removed from the socket retainer. Furthermore, the pin is biased by spring pressure so that the pin cannot be moved unintentionally.

With the foregoing and other objects in view there is provided, a socket retainer assembly for retaining a ball of a support post. The assembly includes a socket retainer body with a channel for receiving the ball and a hole formed therein. The hole is substantially perpendicular to the channel. A pin is disposed in the hole. The pin has a cutout formed therein corresponding to a diameter of the ball. The cutout for aligning with the channel allows entry of the ball into the channel. A spring is disposed at the pin for preventing an unintended rotation of the pin.

In accordance with another feature of the invention, the channel has a c-shape and the channel is constricted at an end opposite the hole for retaining the ball in the channel.

In accordance with an added feature of the invention, a cam surface is disposed at one end of the hole on the socket retainer body. A handle is disposed on an end of the pin. The handle has a cam following surface. The cam following surface engages the cam surface for alternatingly increasing and decreasing the compression on the spring.

In accordance with an additional feature of the invention, the hole has a counterbore at an end thereof opposite the cam surface. The pin has a shoulder disposed at end opposite the handle. The spring is disposed on the pin to engage the shoulder and the counterbore.

In accordance with yet an additional feature of the invention, a 360° rotation of the pin in the hole increases and decreases the compression of the spring at least twice.

In accordance with a further feature of the invention, the pin has a locking position wherein the groove is not aligned with the channel to lock the ball in the channel and an open position wherein the groove aligns with the channel to allow the ball to enter and exit the channel.

In accordance with still a further feature of the invention, the handle has a D-shape and is affixed to the pin with a removable fastener.

In accordance with yet another feature of the invention, the pin extends beyond a top of the counterbore so as to be accessible for assisting in compression of the spring.

In accordance with still another feature of the invention, the channel has a removable liner.

In accordance with another mode of the invention, there is provided a socket retainer for retaining a ball of a support post. The socket retainer includes a body with a channel formed therein for receiving the ball. A rotatable pin is disposed in the body substantially perpendicular to the channel. The pin has a cutout formed therein which corresponds to a diameter of the ball. The cutout aligns with the channel to allow entry of the ball into the channel. A spring is disposed at the pin for preventing an unintended rotation of the pin.

In accordance with yet a further feature of the invention, the channel has a c-shape and the channel is constricted at an end opposite the pin for retaining the ball in the channel.

In accordance with yet an added feature of the invention, a cam surface is disposed on the body at the pin. A handle is disposed on an end of the pin. The handle has a cam following surface, the cam following surface engages the cam surface for alternatingly increasing and decreasing the compression on the spring.

Other features which are considered as characteristic for the invention are set forth in the appended claims.

Although the invention is illustrated and described herein as embodied as a socket retainer for holding a support tube of a bimini top, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 4:
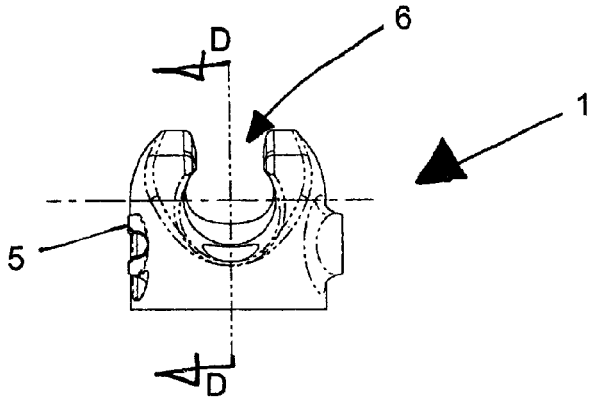
FIG. 4 is a side elevational view of the socket retainer according to the invention without the pin or ball in place showing the receiving area for the ball.
Figure 5:
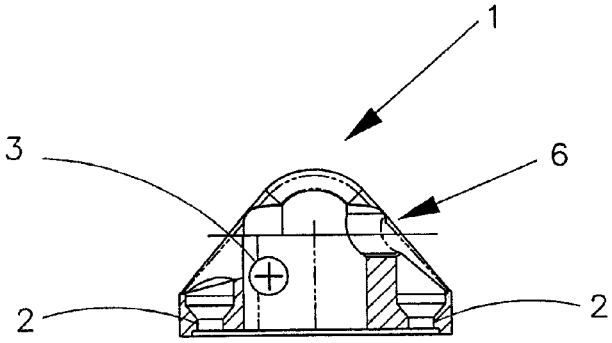
FIG. 5 is a sectional view along line D-D of FIG. 4 of the socket retainer according to the invention without the pin or ball in place.

Referring now to the figures of the drawing in detail and first, particularly, to FIGS. 1 and 3-5, which illustrate the socket retainer or socket retainer body 1 without the ball 100 of the support tube and the pin 30 in place. The socket retainer 1 has a c-shaped channel 6 for receiving the ball 100 of the support tube, where the channel 6 has a c-shaped cross-section that extends beyond the diameter of the ball 100 such that the ball cannot be pulled out of the top of the channel 6. The channel 6 is also reduced in size on its backside so that the ball 100 cannot pass directly through the socket retainer 1. The reduction in size can be on any of the surfaces of the channel 6 that will prevent the ball from escaping the channel 6 (FIG. 4). The socket retainer 1 can be made of any material that is sufficiently hard and which is resistant to corrosion such as stainless steel. The socket retainer includes a replaceable plastic insert 10 as a liner for the channel 6 in order to prevent wear on the ball 100. The socket retainer 1 includes holes 2 for mounting the socket retainer 1 on a surface.

The socket retainer 1 includes a hole 3 at an insertion side of the channel 6. The hole 3 passes through the socket retainer 1 at an angle that is substantially perpendicular to the walls of the channel 6. One end of the hole 3 includes a counterbore 4. The other end of the hole 3 has a cam surface 5. The cam surface 5 will be discussed in greater detail below.

Figure 1:
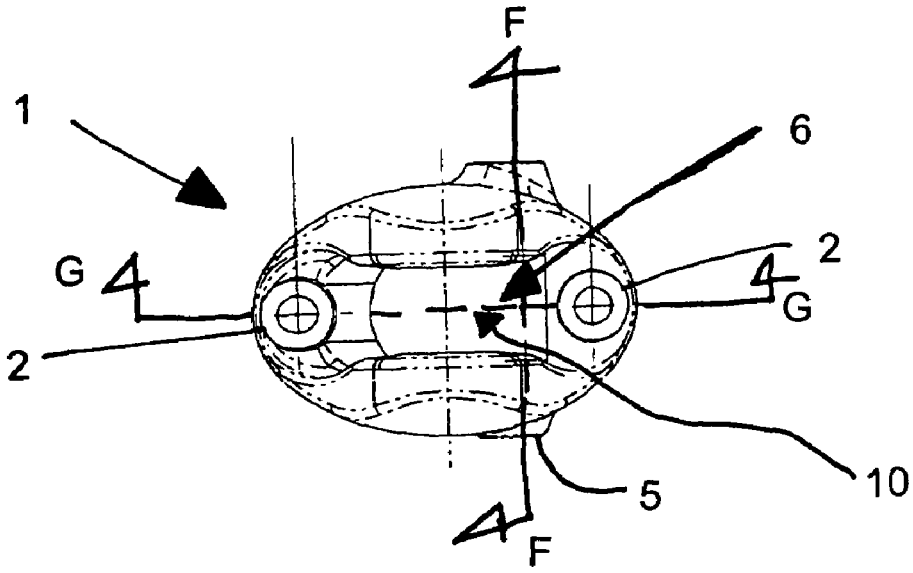
FIG. 1 is a plan view of the socket retainer according to the invention without the pin or ball in place.
Figure 2:
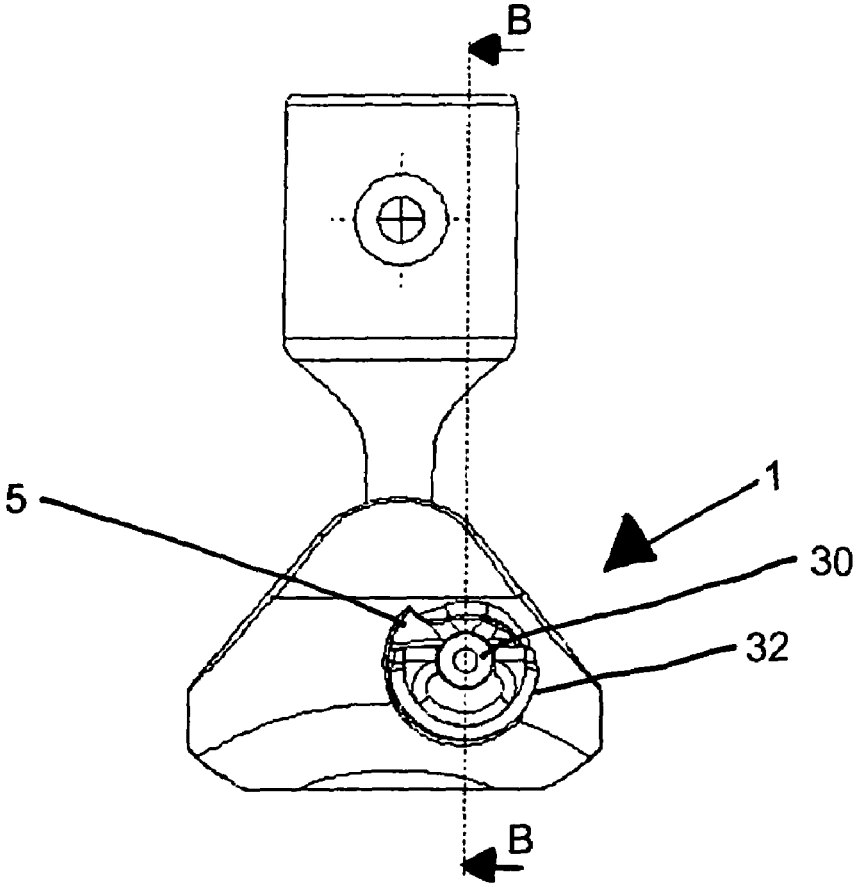
FIG. 2 is a side elevational view of the socket retainer according to the invention showing the pin and ball in place.
Figure 3:
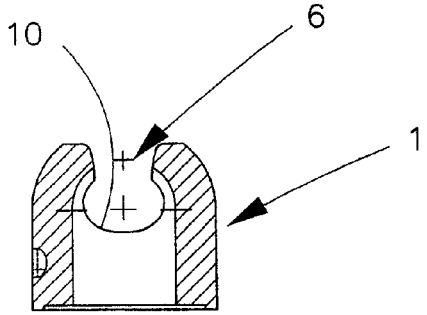
FIG. 3 is a sectional view along line A-A of the socket retainer according to the invention without the pin or ball in place showing the receiving area for the ball.
Figure 6:
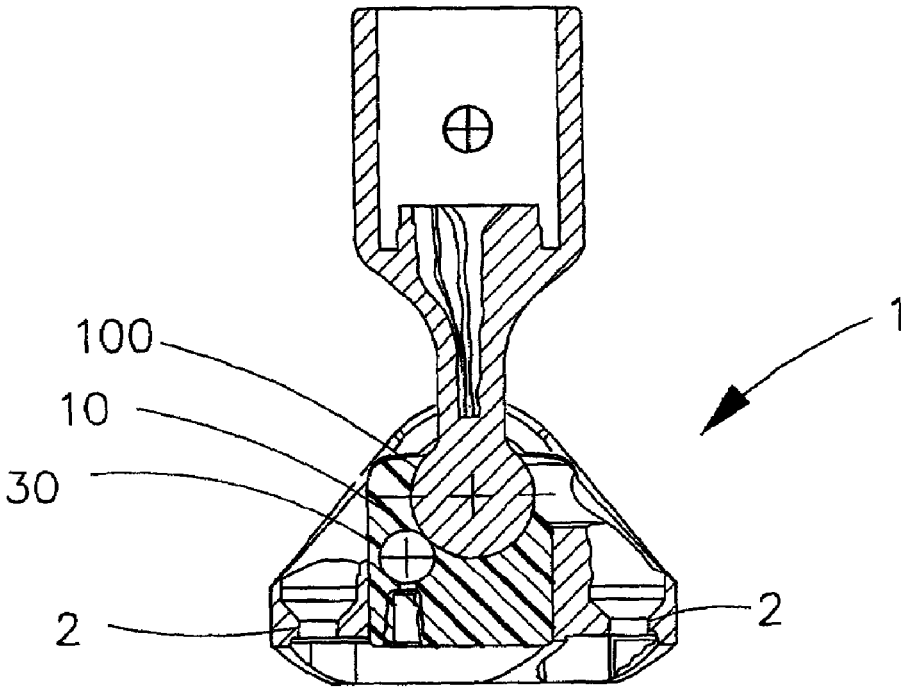
FIG. 6 is a sectional view along line G-G of FIG. 1 of the socket retainer according to the invention with the pin and ball in place.
Figure 7:
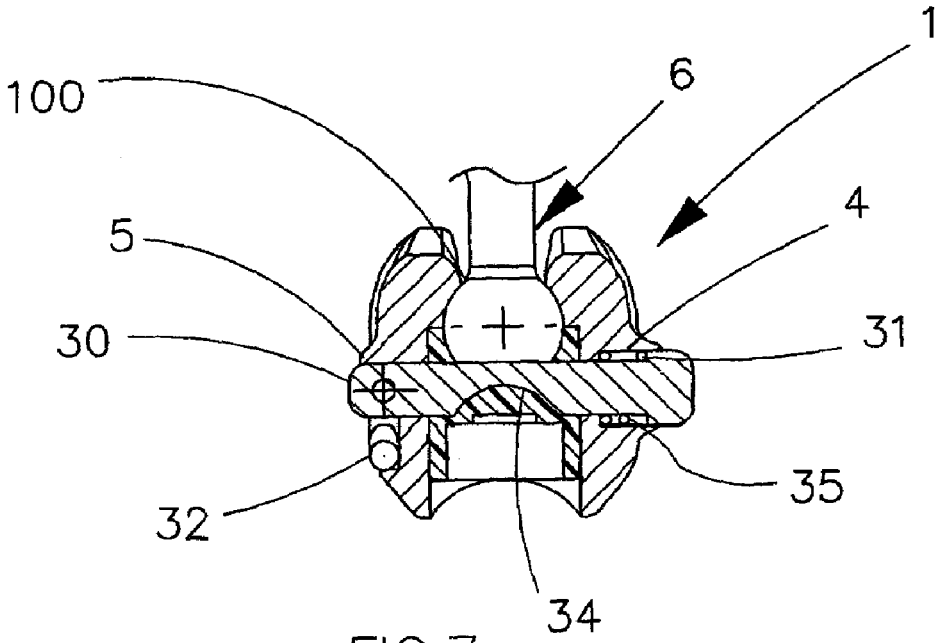
FIG. 7 is a sectional view along line F-F of FIG. 1 of the socket retainer according to the invention with the pin and ball in place.
Figure 8:
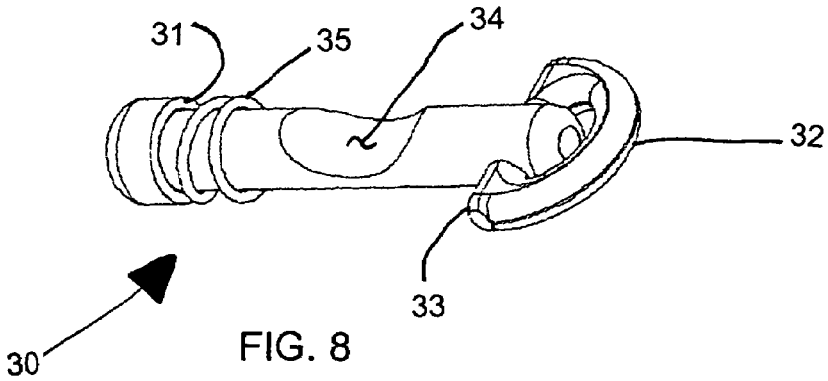
FIG. 8 is a perspective view of the pin according to the invention.
Figure 9:
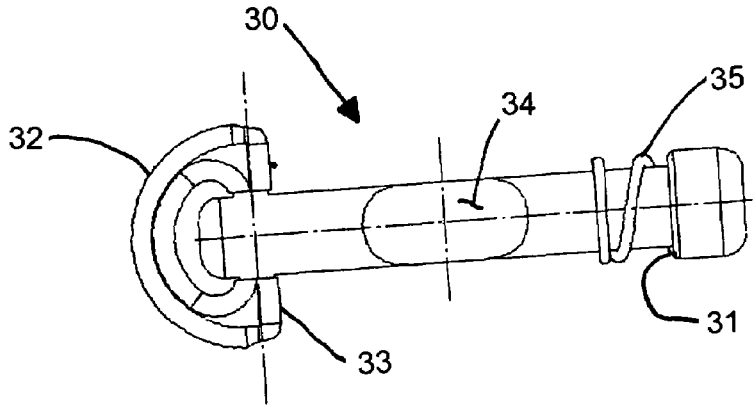
FIG. 9 is a plan view of the pin according to the invention.
Figure 10:
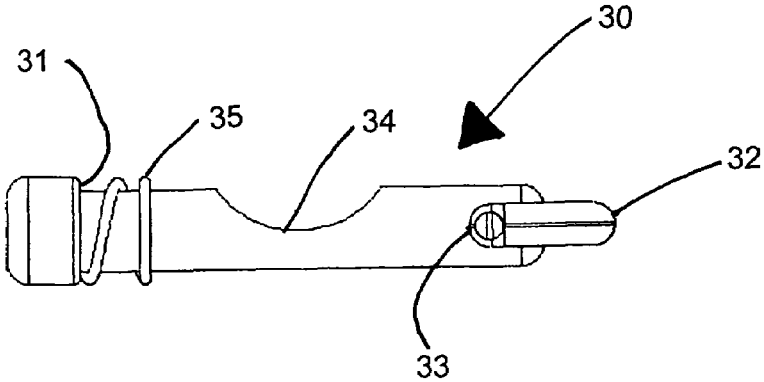
FIG. 10 is a side elevational view of the pin according to the invention.

As shown in FIGS. 2, 6, and 7 a pin 30 is provided that is disposed in the hole 3 of the socket retainer. The pin 30 is fully functional when disposed in the hole 3 and allows the ball 100 to be inserted and removed without taking the pin out of the hole. The pin 30 need only be removed from the hole 3 for maintenance purposes.

The pin 30 has a shoulder 31 on one of its ends and a removable handle, actuating member, or knob 32 on its other end. The handle 32 includes a cam following surface 33. Although the handle 32 is shown having a D-shape and attached by a threaded pin, it is not necessary that the handle be of this construction. Any construction that can function and move the pin 30 and allows for easy assembly is acceptable. The pin 30 also includes a cutout or notch 34 that corresponds to the diameter of the ball 100. A spring 35 is disposed to abut the shoulder 31 of the pin 30. The spring 35 may be a helical spring.

The pin 30 is disposed in the hole 3 of the socket retainer 1 so that the spring 35 is positioned in the counterbore 4. The opposite end of the pin 30 projects out of the other end of the hole 3 where the handle 32 disposed. The handle 32 compresses the spring 35 so that the pin 30 is securely held in place in at least two positions. The pin 30 is held in a position where the cutout 34 aligns with the channel 6 (a position that allows the ball 100 to be inserted or removed from the channel 6) or a position where the cutout 34 does not align with the channel 6 (a locking position that does not allow the ball 100 to be removed or inserted from the channel 6). The pin 30 is moveable between the two positions by a rotation of the handle 32 and thus the pin 30. As the handle 32 is rotated, the cam following surface 33 travels across a high side of the cam surface 5 and increases the compression of the spring 35 between the shoulder 31 and the counterbore 4. After the cam following surface 33 passes the high the side of the cam surface 5 the amount of compression of the spring is reduced and the pin 30 is in the other of the two positions. The cam surface 5 prevents any unintentional movement of the pin 30. Although described as a cam surface the same effect can be achieved by a notch or series of notches in the socket retainer 1 interacting with the handle 32 that would require additional force to overcome the tension of the spring 35 to compress the spring 35.

A basic operation of the device will be described. The pin 30 is rotated such that the cutout 34 aligns with the channel 6 of the socket retainer 1. The ball 100 is inserted into the channel 6. The knob 32 is rotated by compressing the spring 35, via the cam surface 5 and cam following surface 33, such that the cutout 34 is not aligned with the channel 6. The ball 100 is thus captured in the channel 6 and cannot be removed without realigning the cutout 34 with the channel 6 by a rotation of the pin 30. This construction makes it very simply to install the ball 100 of the support tube in the socket retainer 1 without having to remove the pin 30 from the retainer.

I claim:

1. A socket retainer assembly for retaining a ball of a support post, the assembly comprising:

a socket retainer body having a channel for receiving the ball and a hole formed therein, said hole being substantially perpendicular to said channel, said channel having a c-shape and said channel being constricted at an end opposite said hole for retaining the ball in said channel;

a pin disposed in said hole, said pin having a cutout formed therein corresponding to a diameter of the ball, said pin being rotatable for aligning said cutout with said channel to allow entry of the ball into said channel;

a spring disposed at said pin for preventing an unintended rotation of said pin;

and a cam surface disposed at one end of said hole on said socket retainer body; and a handle disposed on an end of said pin, said handle having a cam following surface, said cam following surface engaging said cam surface for alternatingly increasing and decreasing the compression on said spring.

2. The assembly according to claim 1, wherein said hole has a counterbore at an end thereof opposite said cam surface and said pin has a shoulder disposed at end opposite said handle, said spring being disposed on said pin engaging said shoulder and said counterbore.

3. The assembly according to claim 1, wherein a 360° rotation of said pin in said hole increases and decreases the compression of said spring at least twice.

4. The assembly according to claim 1, wherein said pin has a locking position wherein said cutout is not aligned with said channel for locking the ball in the channel and an open position wherein said groove aligns with said channel for allowing the ball to enter and exit the channel.

5. The assembly according to claim 1, wherein said handle has a D-shape and is affixed to said pin with a removable fastener.

6. The assembly according to claim 1, wherein said pin extends beyond a top of said counterbore so as to be accessible for assisting in compression of said spring.

7. The assembly according to claim 1, wherein said channel has a removable liner.

8. A socket retainer for retaining a ball of a support post, the socket retainer comprising:

a body having a channel formed therein for receiving the ball;

a rotatable pin disposed in said body substantially perpendicular to said channel, said pin having a shoulder, and said pin having a cutout formed therein corresponding to a diameter of the ball, said cutout for aligning with said channel by the rotation of said pin to allow entry of the ball into said channel; and a spring disposed axially on said pin and abutting said shoulder for preventing an unintended rotation of said pin.

9. The socket retainer according to claim 8, wherein said channel has a c-shape and said channel is constricted at an end opposite said pin for retaining the ball in said channel.

10. A socket retainer assembly for retaining a ball of a support post, the assembly comprising:

a socket retainer body having a channel for receiving the ball and a hole formed therein, said hole being substantially perpendicular to said channel;

a pin disposed in said hole, said pin having a cutout formed therein corresponding to a diameter of the ball, said cutout for aligning with said channel to allow entry of the ball into said channel;

a spring disposed at said pin for preventing an unintended rotation of said pin;

a cam surface disposed on said body at said pin; and a handle disposed on an end of said pin, said handle having a cam following surface, said cam following surface engaging said cam surface for alternatingly increasing and decreasing the compression on said spring.

11. The socket retainer according to claim 10, wherein a 360° rotation of said pin increases and decreases the compression of said spring at least twice.

12. The socket retainer according to claim 9, wherein said pin has a locking position wherein said cutout is not aligned with said channel for locking the ball in the channel and an open position wherein said groove aligns with said channel for allowing the ball to enter and exit the channel.

13. The socket retainer according to claim 10, wherein said handle has a D-shape and is affixed to said pin with a removable fastener.

14. The socket retainer according to claim 9, wherein said channel has a removable liner.

15. A socket retainer assembly for retaining a ball of a support post, the assembly comprising:

a socket retainer body having a channel for receiving the ball and a hole formed therein, said hole being substantially perpendicular to said channel;

a pin disposed in said hole said pin having a shoulder, and, said pin having a cutout formed therein corresponding to a diameter of the ball, said pin being rotatable for aligning said cutout with said channel to allow entry of the ball into said channel; and a spring disposed axially on said pin and abutting said shoulder for preventing an unintended rotation of said pin, said spring being a helical spring disposed on said pin.

16. The socket retainer according to claim 1, wherein said channel and said cutout each have a respective longitudinal axis, said longitudinal axes being aligned with one other in an open position wherein said cutout aligns with said channel for allowing the ball to enter and exit the channel.

17. The socket retainer according to claim 1, wherein said channel has a longitudinal side configured to allow the support post to project therethrough.

18. A socket retainer assembly for retaining a ball of a support post, the assembly comprising:

a socket retainer body having a channel for receiving the ball, said channel having two longitudinal ends, one of said longitudinal ends being constricted for preventing the ball from being removed from said channel said channel having a longitudinal open side between said two longitudinal ends, said longitudinal open side being configured for allowing the support post to project from said channel;

a hole formed in said socket body at said another longitudinal end, said hole being substantially perpendicular to said channel;

a pin disposed in said hole said pin having a shoulder, and, said pin having a cutout formed therein corresponding to a diameter of the ball, said cutout for aligning with said channel thereby allowing the ball to be inserted into or removed from said channel; and a spring disposed axially on said pin and abutting said shoulder for preventing an unintended rotation of said pin and;

said channel and said cutout each having a respective longitudinal axis, said longitudinal axes being aligned with one other in an open position wherein said cutout aligns with said channel for allowing the ball to enter and exit the channel.

* * * * *